US005428877A

United States Patent [19]

Heerten

[11] Patent Number: 5,428,877

[45] Date of Patent: Jul. 4, 1995

[54] SEALING SHEETING OF SWELLABLE CLAY IMPERVIOUS TO WATER AND/OR OIL

[75] Inventor: Georg Heerten, Lübbecke, Germany

[73] Assignee: Naue-Fasertechnik GmbH & Co. KG, Germany

[21] Appl. No.: 32,274

[22] Filed: Mar. 17, 1993

[30] Foreign Application Priority Data

Apr. 2, 1992 [DE] Germany ..... 42 11 032.7

[51] Int. Cl.[6] ..... E02B 3/16; E02B 31/00; B32B 5/30; B32B 5/24; B32B 5/06; C09K 3/10

[52] U.S. Cl. ..... 28/112; 156/276; 405/38; 405/107; 112/420; 428/234; 428/235

[58] Field of Search ..... 28/107, 112; 112/420; 405/15, 16, 38, 107; 428/102, 234, 235, 241, 283, 913; 156/276, 279

[56] References Cited

U.S. PATENT DOCUMENTS

| | | | |
|---|---|---|---|
| 4,501,788 | 2/1985 | Clem | 405/107 X |
| 4,810,573 | 3/1989 | Harriett | 405/107 X |
| 5,041,330 | 8/1991 | Heerten et al. | 405/38 X |
| 5,091,234 | 2/1992 | McGroarty et al. | 405/107 X |
| 5,174,231 | 12/1992 | White | 112/420 |
| 5,221,568 | 6/1993 | Heerten et al. | 428/213 |
| 5,237,945 | 8/1993 | White | 405/38 X |
| 5,246,770 | 9/1993 | Bottiglione et al. | 156/276 X |

FOREIGN PATENT DOCUMENTS 0449182 10/1991 European Pat. Off. .

*Primary Examiner*—John J. Calvert
*Attorney, Agent, or Firm*—Larson and Taylor

[57] ABSTRACT

A method is provided for the continuous production of sealing sheeting impervious to water and/or oil, in the case of which between a substrate layer and a non-woven material covering layer a swellable clay is needle punched in position, a swellable clay additionally strewn on the top side of the covering layer being at the same time incorporated in the covering layer. After this the swellable clay present in the covering is moistened and dried again. In accordance with a modified form of the invention use is only made of a substrate consisting of a non-woven material, a woven fabric, a knitted fabric and/or a film, the film being a synthetic resin film, a synthetic resin film reinforced with fabric or paper, and a large pored non-woven material or a non-consolidated intersecting fiber crimped non-woven material or a random fiber non-woven material on which the pulverulent swellable clay is strewn, incorporated by needle punching, moistened and dried. However instead of needle punching it is possible for knitting and/or sewing to be utilized.

6 Claims, No Drawings

SEALING SHEETING OF SWELLABLE CLAY IMPERVIOUS TO WATER AND/OR OIL

The invention relates to sealing sheeting impervious to water and/or oil and consisting essentially of a layer of swellable clay provided with covering layers.

Such sealing sheeting is known, see the European patent publication 0 059 625, in the case of which a flexible substrate layer bears a bentonite layer, on which there may be in turn a covering layer. All three layers, that is to say, the substrate layer, which may be a non-woven material, the bentonite layer and the covering layer, which may be sheeting whose composition is not described in detail, are joined together by means of an adhesive. In the case of such a product the substrate layer and the covering layer are only connected together by means of the bentonite layer with the result when the sheeting is used, the bond is released by wetting of the bentonite layer, and there is no permanent join between substrate layer and the covering layer. This is something which makes itself more particularly felt when the sheeting is employed for its intended purpose because the bentonite layer in contact with water freely swells in all directions to a substantial degree and in this case a bentonite layer will act like a lubricant film between the substrate layer and the covering layer, this being more particularly a disadvantage in the case of laying such sealing sheeting on embankments.

In order to overcome the main disadvantage of this sealing sheeting material the applicant has already developed sealing sheeting, which is described in its German patent specification 3,704,503. This sealing sheeting consists essentially of a substrate layer, a layer of swellable clay and a covering layer, the substrate and/or covering layers consisting of a non-woven material and the layer, which possibly does not consist of a non-woven material, consists of a woven or knitted fabric or a synthetic resin film, all three layers being needle punched together. In the case of such a sealing sheet the substrate layer and the covering layer remain permanently connected together owing to the needle punching even after swelling of the swellable clay, the bentonite particles being trapped as in a cage by the fibers, which extend from the covering layer through the bentonite layer as far as the substrate layer and vice-versa. This ensures that during use of these sealing sheets the moist bentonite layer is not able to function as a lubricant plane and there is a true transfer of transverse or shear forces from the covering layer to the substrate layer with the result that for instance on embankments there is no chance of slipping of the shielding layer consisting of gravel or, respectively, pebbles. Furthermore the applicant's said German patent specification 3,704,503 has already indicated that a reduction in the permeability to water of such sealing sheeting may be obtained if during production firstly flour-like bentonite is applied to the substrate layer and if necessary is shaken and then, when this has been done, the granular bentonite is put on. Instead of shaking the flour-like bentonite into the substrate layer it is furthermore possible to so proceed that the substrate layer is firstly impregnated with an aqueous bentonite suspension or an aqueous bentonite paste is rolled on and then, after any necessary drying, the granular bentonite is applied. If desired it is possible for the covering layer, prior to the application thereof, to be also processed in the manner described like the substrate layer.

Despite this treatment and even if additionally the substrate and covering layers, pretreated with bentonite by shaking or impregnation, are employed, tests in the laboratory and field trials have shown that in the overlap joins, owing to fine-pored non-woven material placed in superposed relationship, it is not quite possible to achieve the same water permeability coefficients as in the sealing sheeting itself. This is certainly owing to the fact that the fine pored non-woven materials are not completely filled with bentonite, for instance because for instance the bentonite powder or, respectively, the bentonite paste or, respectively, the bentonite suspension does not completely penetrate into the interstices of the non-woven material or a part of the incorporated finely pulverulent bentonite falls out during rolling up, during storage, during shipping and during unrolling and laying. This is probably the reason why the above mentioned substrate and covering layers pretreated by shaking bentonite into them are by themselves not completely capable of fulfilling the requirements, which are specified for high quality sealing sheeting.

Accordingly one object of the present invention is to provide a method rendering it possible to fill or charge the substrate and/or covering layer consisting of non-woven material with pulverulent or granular swellable clay and more particularly with pulverulent bentonite in such a manner that there is not only an excellent sealing effect at the overlaps but also such a state of the filling, more particularly in the covering layer of the finished sealing sheeting that it is possible to avoid the incorporated swellable clay or, respectively, the bentonite falling out or being lost as dust during rolling up, during storage, during shipping and during unrolling and/or laying.

In order to achieve this object in the invention the substrate and/or covering layer consists of a non-woven material, into which during the needle punching of the three layers additionally externally applied swellable clay is incorporated by needle punching and is then moistened and dried again, the fiber reinforced skin of swellable clay being formed, which is firmly connected with the overall structure.

A significant feature of the invention is that at least one layer consists of a non-woven material and the swellable clay applied thereto is, during the needle punching operation, externally applied and incorporated by such punching into the non-woven material and after this the covering layer provided with the needle punched in swellable clay is caused to swell by the action of water and after this is dried again.

The present invention consequently relates to a method for the continuous production of sealing sheeting impervious to water and/or oil, which essentially consists of a substrate layer, a layer of swellable clay, more particularly bentonite, and a covering layer, at least one of the layers being a non-woven material and the dry pulverulent or granular swellable clay being applied to the substrate layer, the covering layer is placed thereover and the resulting triple-layer material is passed through a needle punching machine for the purpose of needle punching together the substrate layer and the covering layer, characterized in that prior to needle punching pulverulent swellable clay is applied to the top surface of the covering layer consisting of non-woven material, the resulting quadruple-layer material is needle punched, then the swellable clay needle punched into the covering layer is moistened with water and then dried again and if desired then the substrate layer is processed in a suitable manner.

In accordance with a further advantageous development of the invention the covering layer consists of a non-woven material and the substrate layer consists of a fabric or a film, the use of a fabric however being preferred. As a film it is possible to use not only synthetic resin films but furthermore paper, preferably soda kraftpaper.

The fabric employed in accordance with the invention must, in the case of the use of floury bentonite, be so densely woven that even extremely finely pulverulent bentonite with a particle size in the μm range is not able to penetrate through the fabric. Preferably a woven ribbon fabric is employed.

Moistening can be performed using cold, warm or hot water or with steam.

When laying sealing sheeting produced in accordance with the invention with the use of fabrics as a substrate layer, in the case of which the covering layer consists of a non-woven material filled with bentonite, one may also be certain that at the overlaps there are practically the same water permeability values as in the sealing sheeting itself.

The sealing sheeting produced in accordance with the invention is highly suitable as safety sealing underlays underneath a water-tight layer of synthetic resin film. In the event of damage to the synthetic resin film, as for instance as a consequence of the formation of holes or tears, the water seeping through this leak will cause the swellable clay present in the sealing sheeting produced in accordance with the invention and which is preferably a naturally occurring sodium bentonite to tumesce and hence close the leak in a sort of self-healing action.

The non-woven materials utilized consist preferably of high quality synthetic resin fibers, more particularly polyethylene, polypropylene, polyester, polyacryl and/or polyamide fibers. For refuse tips it is more particularly preferred to use non-woven materials consisting of high density polyethylene (HDPE) or polypropylene, which is so rot-proof as to be resistant as regards all substances occurring in the soil and consequently may be shown to have an extremely long length of life. The great tear resistance thereof is responsible for substantial resistance to mechanical strains.

As regards the structure of the non-woven materials utilized in the invention it is mainly a question of spun fiber non-wovens mechanically consolidated by needle punching. They have such a structure that the curled, joined together fibers constitute a flat structure with innumerable labyrinth-like passages. The structure of the non-woven materials may be made coarser or finer in accordance with the particular application with the result that optimum adaptation to the set requirements may be ensured. The mechanical consolidation ensures a structure, which is of substantial significance for the purpose of the invention. And instead of non-woven materials mechanically consolidated by needle punching it is furthermore possible to employ non-woven materials, which have been mechanically consolidated by stitching techniques or by turbulence, or such non-woven materials, which are chemically consolidated.

An other advantageous modified feature of the invention is such that a substrate layer is employed composed of non-woven material, woven or knitted fabric and/or film, such film being a synthetic resin film, synthetic resin film reinforced with fabric or paper and preferably soda kraftpaper, and a porous structure composed of large pored, chemically or mechanically consolidated or only partly consolidated non-woven material or of a non-consolidated intersecting fiber crimped non-woven material or a random fiber non-woven material, in which respect as distinguished from the above mentioned embodiments no layer of swellable clay is directly applied to the substrate layer, and instead the clay is applied at a suitable rate only onto or into the porous structure, the swellable clay preferably being a naturally occurring sodium bentonite in a pulverulent or granular form. The sheeting so obtained is then passed through suitable needle punching machines, on the one hand the swellable clay being worked into the porous structure and the porous structure itself being mechanically consolidated like in conventional needle punching technology. The consolidation may however be performed by knitting and/or sewing. Following this the sheeting obtained is moistened with water on the side to which the bentonite was applied, or on both sides.

In the case of the use of needle punching it may be an advantage if needle punching machines are placed in tandem, one of them being fitted with needles whose hooks are directed downwards and the other being fitted with needles whose hooks are directed upwards. However it is also possible to employ combined needle punching machines, which are each fitted with needles of both types.

The sheet structure consolidated by needle punching is then sprayed with water on the upper and/or lower surface and then dried. Drying can be performed for instance by infrared radiation or by passing the web through a kiln or a hot air tunnel. For different applications it may be an advantage if the bentonite retains a certain quantity of moisture.

The sealing sheeting so obtained may either be utilized with the substrate layer as a sealing sheet or the paper layer is removed and the incorporated clay is caused to swell starting from this side and drying is then performed. Such a product naturally has an optimum sealing action in the overlapped zones. In accordance with a preferred modification of the invention the paper web is removed only at the edges for a width which corresponds to the width of overlap. This method can also be employed in conjunction with other working embodiments as described in the above, in which paper is utilized as the substrate layer.

The sealing webs in accordance with the invention find particular application as sealing structures for protection of the ground water and then more particularly function as mineral components of a combined sealing structure in conjunction with synthetic resin sealing materials. In the case of scattered leaks or perforations in the synthetic resin sealing webs covering the same, the sealing webs in accordance with the invention are responsible, as already mentioned, for a sort of self-healing action for the damaged synthetic resin sealing web.

The present invention will now be explained in the following examples without such examples having any limiting effect.

EXAMPLE 1

A roll of woven ribbon fabric with a width of 4 meters is unrolled from a stand and supplied to a needle punching machine as a substrate layer. During the process of unrolling bentonite powder is applied at a rate of approximately 3,500 g/m$^2$ on the woven ribbon fabric serving as a substrate layer. Simultaneously a roll of non-woven material (6.7 dtex fibers) is supplied via a further stand as a covering layer for the bentonite layer. Bentonite powder is additionally applied to this covering layer at a rate of 1,500 g/m$^2$. These four layers are then run through the needle punching machine, the bentonite powder arranged on the covering layer being needle punched into the covering layer and the layers being mechanically fixed together.

The needle punching machine has a plurality of needle beds. Each needle bed bears thousands of needles. The needle beds are very rapidly reciprocated vertically (i. e. approximately 10000 strokes per minute). The needles, which have notches, pierce all layers, the notches ensuring that the individual fibers are looped together with the result that a firm composite structure is formed, wherein the bentonite particles are more or less encapsulated. The needle punching process furthermore means that some of the bentonite passes from the bentonite intermediate layer into the covering layer to the extent that space is available therein.

After leaving the needle punching machine the covering layer is moistened by the application of water down onto it at a rate of approximately 300 g/m$^2$ and it is then dried, something that may be advantageously performed using infrared lamps.

The sealing sheeting obtained in this manner causes the covering layer to appear in the form of a coherent, fiber-reinforced integument, which fulfills its set purpose.

EXAMPLE 2

For the manufacture of water and/or oil impermeable sealing sheeting a PP woven ribbon fabric (100 g/m$^2$) is provided with a heavy crimped pile of 350 g/m$^2$ and is then strewn with activated sodium bentonite at a rate of 3000 g/m$^2$. The fiber pile charged with bentonite and the substrate fabric are passed through a needle punching machine and mechanically consolidated.

Following this the non-woven material charged with bentonite is sprayed with water on the upper face for fixing the bentonite at a rate of 300 ml/m$^2$ and dried by means of infrared lamps at 300° C. for 2 minutes. In this case as well a coherent, fiber-reinforced leathery skin owing to the treatment with water.

For the manufacture of sealing sheeting in accordance with this example it is naturally possible to furthermore employ non-woven materials, woven or knitted fabrics and/or films of any desired raw material and any desired weight per unit area and in any desired combinations. By the same token the weight per unit area, the selection of raw material and the titer of the fibers used in crimped pile or a random fiber pile may be varied in accordance with the field of application. The bentonite or, respectively, the swellable clay may be applied as a powder or in a granule form.

We claim:

1. A method for the continuous production of a sealing sheeting impervious to water and oil, the sheeting including a substrate layer, a layer of dry pulverulent or granular swellable clay and a covering layer which is a non-woven material, the method comprising the steps of:

applying the dry swellable clay to an inside surface of the substrate layer to form the clay layer;

placing an inside surface of the cover layer onto the clay layer;

applying pulverulent swellable clay to an outside surface of the cover layer, either before or after said placing step;

needle punching together the cover layer and the substrate layer with the clay layer therebetween by passage through a needle punching machine, whereby the swellable clay on the outside surface of the cover layer is needle punched into the covering layer;

moistening of the clay needle punched into the outside surface of the covering layer with water to cause swelling of the moistened clay in the cover layer; and drying of the moistened clay in the outside surface of the cover layer to form an outer skin for the sheeting.

2. A method for the continuous production of a sealing sheeting as claimed in claim 1 wherein both applying steps include the applying of bentonite as the clay.

3. A method for the continuous production of a sealing sheeting as claimed in claim 1 wherein said applying step includes the applying of the clay to a substrate layer formed as a film.

4. A method for the continuous production of a sealing sheeting as claimed in claim 3 wherein said applying step includes the applying of the clay to a substrate layer formed as a fabric.

5. A method for the continuous production of a sealing sheeting as claimed in claim 2 wherein said applying step includes the applying of the clay to a substrate layer formed as a film.

6. A method for the continuous production of a sealing sheeting as claimed in claim 5 wherein said applying step includes the applying of the clay to a substrate layer formed as a fabric.

* * * * *